US005553883A

United States Patent [19]

Erb

[11] Patent Number: 5,553,883

[45] Date of Patent: Sep. 10, 1996

[54] SNOWBOARD BINDING WHICH PERMITS ANGULAR REORIENTATION OF A USER'S FOOT WHILE MAINTAINING THAT FOOT ATTACHED TO THE SNOWBOARD

[76] Inventor: George A. Erb, 2086 Cervato Dr., Camarillo, Calif. 93012

[21] Appl. No.: 418,253

[22] Filed: Apr. 6, 1995

[51] Int. Cl.[6] ..... A63C 9/081

[52] U.S. Cl. ..... 280/607; 280/618; 280/14.2; 441/70

[58] Field of Search ..... 280/14.2, 607, 280/613, 617, 618, 626, 629, 630, 633, 634; 441/70, 74, 75, 65, 68

[56] References Cited

U.S. PATENT DOCUMENTS 4,871,337 10/1989 Harris .
4,964,649 10/1990 Chamberlin .
5,021,017 6/1991 Ott .
5,028,068 7/1991 Donovan .
5,035,443 7/1991 Kincheloe .
5,085,455 2/1992 Bogner .
5,236,216 8/1993 Ratzek .
5,261,689 11/1993 Carpenter .
5,344,179 9/1994 Fritschi .
5,354,088 10/1994 Vetter .
5,356,170 10/1994 Carpenter et al. ..... 280/618

*Primary Examiner*—Richard M. Camby
*Attorney, Agent, or Firm*—Terry M. Gernstein

[57] ABSTRACT

A binding that attaches a user's foot to a snowboard includes a footplate that is rotatably and continuously fixed to the snowboard and which is attached to the user's foot via straps and a rear support which contact a snowboot. An anchor fixes the footplate to the snowboard with the bottom of the footplate as close to the snowboard as possible whereby the bottom of a snowboarder's foot is as close to the plane of the snow as possible, and is slidably engaged with the footplate to permit that footplate to rotate while remaining attached to the snowboard. Anti-pivot spring pins located outside the outer perimeter of a user's snowboot accurately and repeatably secure the footplate to the snowboard once the footplate is in the selected angular orientation on the snowboard.

15 Claims, 6 Drawing Sheets

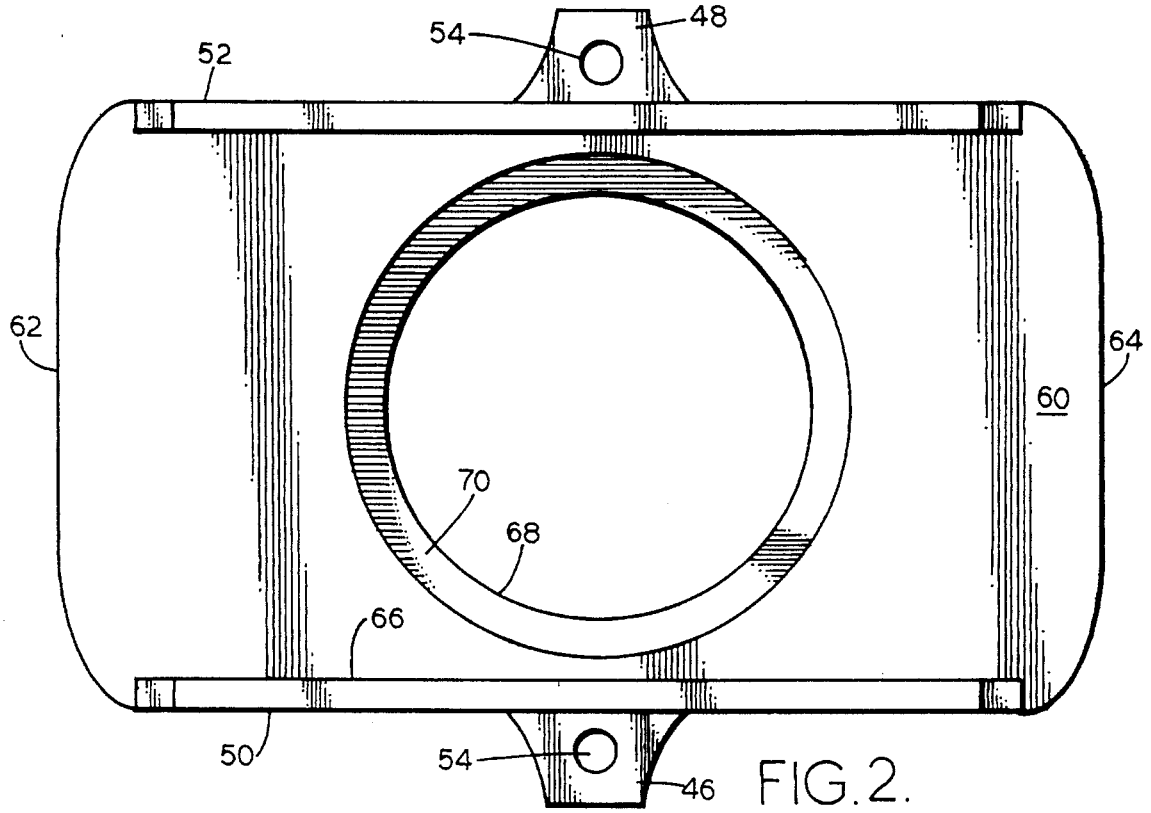
FIG. 2.
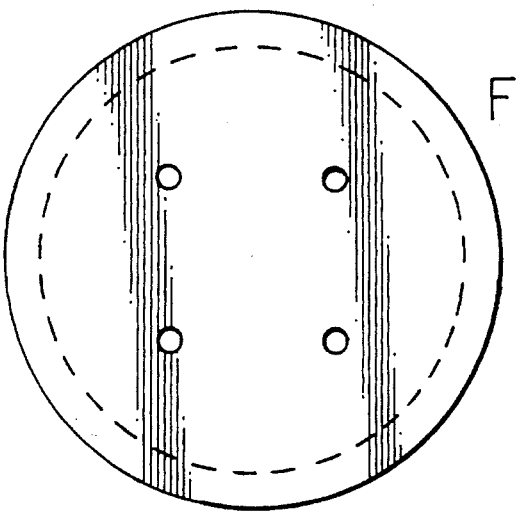
FIG. 3.
FIG. 4.
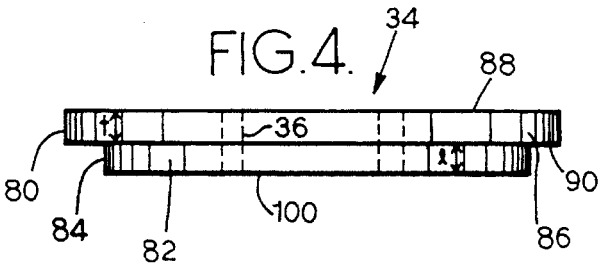

SNOWBOARD BINDING WHICH PERMITS ANGULAR REORIENTATION OF A USER'S FOOT WHILE MAINTAINING THAT FOOT ATTACHED TO THE SNOWBOARD

TECHNICAL FIELD OF THE INVENTION

The present invention relates to the general art of snowboarding, and to the particular field of bindings for snowboards.

BACKGROUND OF THE INVENTION

Snowboarding has become extremely popular in recent times. Snowboarders generally adopt a stance with one foot in front of the other on a single board and ski using the single board. This activity has generated an entire subculture of enthusiasts and requires its own unique skills. For example, a snowboarder can place either his or her right or left foot forward on the board, can change stances or the like.

Generally, the forward foot is placed at an angle with respect to the longitudinal centerline of the snowboard during the snowboarding. Still further, most snowboarders like to have their feet as close to the snow as possible for reasons of control, comfort and the like. Still further, some snowboarders like to have their foot at one angle while others like to have their foot at another angle, and some snowboarders actually like to change the angle depending on conditions associated with the activity.

As noted above, most snowboarding is carried out with one foot, preferably the lead foot, oriented at an angle with respect to the longitudinal centerline of the snowboard. While this is effective and efficient for snowboarding, it is not desirable under all circumstances. Specifically, it is not desirable when skateboarding or when riding a ski lift. Skateboarding is effected by removing one foot, such as the rear foot, from the snowboard, and using that removed foot to contact the snow and propel the snowboarder forward in a skating movement. As can be understood, if the foot remaining attached to the snowboard is at an angle with respect to the longitudinal skateboarding will be uncomfortable and awkward and may even place undue stress on the snowboarder's body.

Another problem with the angled orientation of the snowboarder's foot on the snowboard occurs when the snowboarder is riding a ski lift. The angled orientation of the board with respect to the wearer may cause the board to be at an angle with respect to the wearer when that wearer is riding the ski lift. This may cause the board to contact other equipment or to contact other skier's equipment, or to be located in an undesired position. This, in turn, may require the wearer to twist his or her foot into an uncomfortable position while on the lift to hold the snowboard straight. Given the weight and length of the snowboard, holding the snowboard straight via twisting the foot or leg is very stressful to the body.

Some snowboarders actually remove their snowboards when moving across level ground or when riding a ski lift. This is cumbersome. It is also undesirable when the snowboarder demounts the ski lift as he or she must move out of line to replace the snowboard. Holding the snowboard while riding the lift is a potential hazard for skier's below the lift path.

Still further, requiring the snowboarder to maintain his or her foot attached to a snowboard at an angle may be undesirable if the snowboarder wishes to alter his or her snowboarding style or technique during a snowboarding activity. Such altered style or technique may be required or desired due to changed snow conditions, changed slope conditions. The snowboarder may wish to change his or her speed of snowboarding, or even to change his or her style altogether, or to change the amount of control exerted over the activity.

In some conditions, the snowboarder may want to alter the angular orientation of his or her feet with respect to the snowboard to effect a change in style or the like. He or she may even want to switch his or her lead foot. He or she may even want both feet to be at an angle with respect to the snowboard longitudinal centerline.

The difference in styles and desires of snowboarders is most evident in the rental market. One snowboarder may have a preferred position and orientation with respect to the snowboard for a given condition, and skill level, while another snowboarder may have an entirely different position and orientation for the same condition. Therefore, rental snowboards must be changed to suit the renter.

In the past, snowboards have required that the snowboarder's foot be released from the snowboard to effect any significant change in angular orientation of the foot with respect to the longitudinal centerline of the snowboard. The change is effected by removing the snowboarder's foot, loosening fasteners and removing anchoring means which attaches bindings to the snowboard, re-orienting the anchoring means, and re-attaching the fasteners to the snowboard, then re-attaching the snowboarder's foot to the anchoring means.

This procedure has several drawbacks which has inhibited both the overall popularity of the sport and the commercial market portion thereof. The procedure is often cumbersome and onerous and may not be easily carried out during a snowboarding activity. For example, a change from a snowboarding activity to a ski lift riding activity is not easily effected, nor is the reverse change from the orientation desired for riding the ski lift to the orientation desired to snowboard. Certainly, changing style or conditions are not easily accounted for if the snowboarder must stop and remove his or her foot from the board to effect the change in orientation of the foot with respect to the board. Not only is this inconvenient, it may even create a dangerous situation if the snowboarder cannot easily change his or her style, or foot orientation to meet changed conditions or the like. The removal of the snowboarder's foot from the board to effect a significant re-orientation of the foot with respect to the board may even require the use of tools, such as screwdrivers or the like. This is not desirable for many reasons, including the need to carry extra equipment. Still further, loosening and tightening of fasteners such as screws and bolts may cause these fasteners to strip threads and thereby become loose. This, at best, merely damages and degrades equipment, and at worst, may even create a dangerous condition if stripped threads are unknown to the snowboarder. Rental boards are particularly subject to degradation of equipment as they will nearly always be reconfigured for each renter.

Still further, a requirement that the user's foot be removed from the board to reorient the foot creates the condition where, once attached to the board, the user's foot may be inadvertently disconnected from the board.

Experienced snowboarders generally prefer to have their feet as close to the plane of the snow as possible whereby the most control and "feel" can be realized. Skis generally have the bottom of the skier's boot placed directly on the upper surface of the ski so this control can be effected. However, the present inventor is not aware of any snowboards that permit the snowboarder to have the bottom plane of his foot as close to the plane of the snow as possible, i.e., nearly directly on top of the top surface of the snowboard, while also permitting easy and efficient reorientation of that foot with respect to the snowboard as above discussed.

If a snowboarder selects a certain orientation of his foot with respect to the snowboard for a given condition, and that condition arises again at a later time, the snowboarder should have the ability to accurately select that same orientation and still maintain confidence that the reaction of the snowboard will repeat the reaction experienced the previous time the orientation was selected. However, to the inventor's knowledge, no presently existing snowboard provides this repeatability feature in conjunction with the ability to accurately "feel" the snow and to quickly and efficiently change foot orientations. Such repeatability could be important for safety as the snowboarder may expect certain actions and reactions for the snowboard that result from a particular orientation of his foot on the board; if that orientation is not as precise as expected, the actions and reactions may differ enough in some conditions to raise a safety problem.

Therefore, there is a need for a binding for attaching a snowboarder's foot to a snowboard in a manner which permits significant reorientation of one or both of the user's feet with respect to the board without requiring the user's foot to be detached from the board whereby such reorientation can be effected quickly and easily without the need for tools and without the need for the snowboarder to stop a current activity for a great length of time. This binding should also permit the snowboarder to keep his or her foot attached to the snowboard when desired, and permit the snowboarder to keep his or her foot in a position with respect to both the board and the snow that is most desired and to have this foot position be repeatable with a high degree of confidence. There is a further need for a snowboard binding that permits the aforediscussed reorientation while positioning the snowboarder's foot as close to the plane of the snow as possible.

OBJECTS OF THE INVENTION

It is a main object of the present invention to provide a binding for a snowboard which permits quick and reliable reorientation of the snowboarder's foot with respect to the snowboard.

It is another object of the present invention to provide a binding for a snowboard that permits a snowboarder to significantly alter the angular orientation of one or both of his or her feet with respect to the snowboard without releasing his or her feet or foot from the snowboard.

It is another object of the present invention to provide a binding for a snowboard that permits a snowboarder to significantly alter the angular orientation of one or both of his or her feet with respect to the snowboard without releasing his or her feet or foot from the snowboard while also positioning the snowboarder's foot as close to the plane of the snow as possible so efficient control of the snowboard can be effected by the snowboarder.

It is another object of the present invention to provide a binding for a snowboard that permits a snowboarder to significantly, accurately and repeatably alter the angular orientation of one or both of his or her feet with respect to the snowboard without releasing his or her feet or foot from the snowboard while also positioning the snowboarder's foot as close to the plane of the snow as possible so efficient control of the snowboard can be effected by the snowboarder.

It is another object of the present invention to provide a binding for a snowboard that permits a user to place his or her foot in an orientation on the board that is comfortable, even during skateboarding and riding a ski lift.

It is another object of the present invention to provide a binding for a snowboard that permits a snowboarder to alter the angular orientation of one or both of his or her feet with respect to the longitudinal centerline of the snowboard by as much as ninety degrees without releasing the foot from the snowboard.

It is another object of the present invention to provide a binding for a snowboard that permits a snowboarder to alter the angular orientation of one or both of his or her feet with respect to the longitudinal centerline of the snowboard so the foot can be moved from toes facing left of the longitudinal centerline to the toes facing right of that longitudinal centerline, and also allow the snowboarder to face either to the front of the snowboard or to the rear of the snowboard.

It is another object of the present invention to provide a binding for a snowboard that permits a snowboarder to alter the angular orientation of one or both of his or her feet with respect to the longitudinal centerline of the snowboard by as much as three hundred sixty degrees without releasing the foot from the snowboard.

It is another object of the present invention to provide a binding for a snowboard that permits a snowboarder to keep his feet the most comfortable position relative to the snow.

It is another object of the present invention to provide a binding for a snowboard that permits a snowboarder to keep his feet the most comfortable position for the particular activity and conditions occurring at any given time.

It is another object of the present invention to provide a binding for a snowboard that is suitable for a rental market.

SUMMARY OF THE INVENTION

These, and other, objects are achieved by a binding that attaches a snowboarder's foot to a snowboard and maintains that foot attached to the snowboard even if the foot is moved through a significant angular reorientation with respect to the longitudinal centerline of the snowboard. This angular reorientation can be from an orientation having the toes facing toward the left of the centerline to an orientation having the toes facing to the right of the centerline, and can cover an angle of as much as ninety degrees or more and can even cover a complete circle of three hundred sixty degrees. It is significant that the foot remains continuously attached to the board during the reorientation. This permits rapid and easy reorientation of the user's foot without requiring special tools and ensures that the user's foot will remain attached to the board. Changing snow conditions, styles, desires, environments and the like can be easily accounted for. In fact, a change to "goofy foot" can be easily achieved by rotating the bindings and changing board directions (e.g., aft becomes forward and vice versa). Safety is increased and stress placed on the snowboarder is decreased given a condition or circumstance. Safety and control are further increased by the binding of the present invention which locates the bottom plane of the snowboarder's foot as close to the top plane of the snowboard as is possible whereby the bottom of the snowboarder's foot is as close to the plane of the snow as possible. This permits the snowboarder to effect the same amount of control over the snowboard as a skier effects for his or her skis.

Specifically, the binding includes a footplate that is attached to the snowboarder's foot, and means for rotatably and continuously attaching that footplate to the snowboard with the bottom of the footplate in direct contact with the top surface of the snowboard as well as means for securing the footplate to the snowboard when it has been placed in a desired orientation on the snowboard. The means for attaching the footplate to the snowboard has a top surface that is coplanar with the top surface of the footplate whereby the snowboarder's boot is as close to the plane of the top surface of the snowboard as possible.

It is noted that the preferred form of the invention is used for a snowboard; however, the present invention can be applied to waterboard by one skilled in the art based on the teaching of the present disclosure.

BRIEF DESCRIPTION OF THE DRAWING FIGURES

FIG. 2 is a top plan view of a footplate which is part of the binding of the present invention, with the straps and rear foot support being deleted from this view for clarity of description.

FIG. 3 is a top plan view of an anchor means for continuously and rotatably attaching the footplate to the snowboard.

FIG. 4 is a side elevational view of the anchor means.

DETAILED DESCRIPTION OF THE PREFERRED EMBODIMENT OF THE INVENTION

Figure 1:
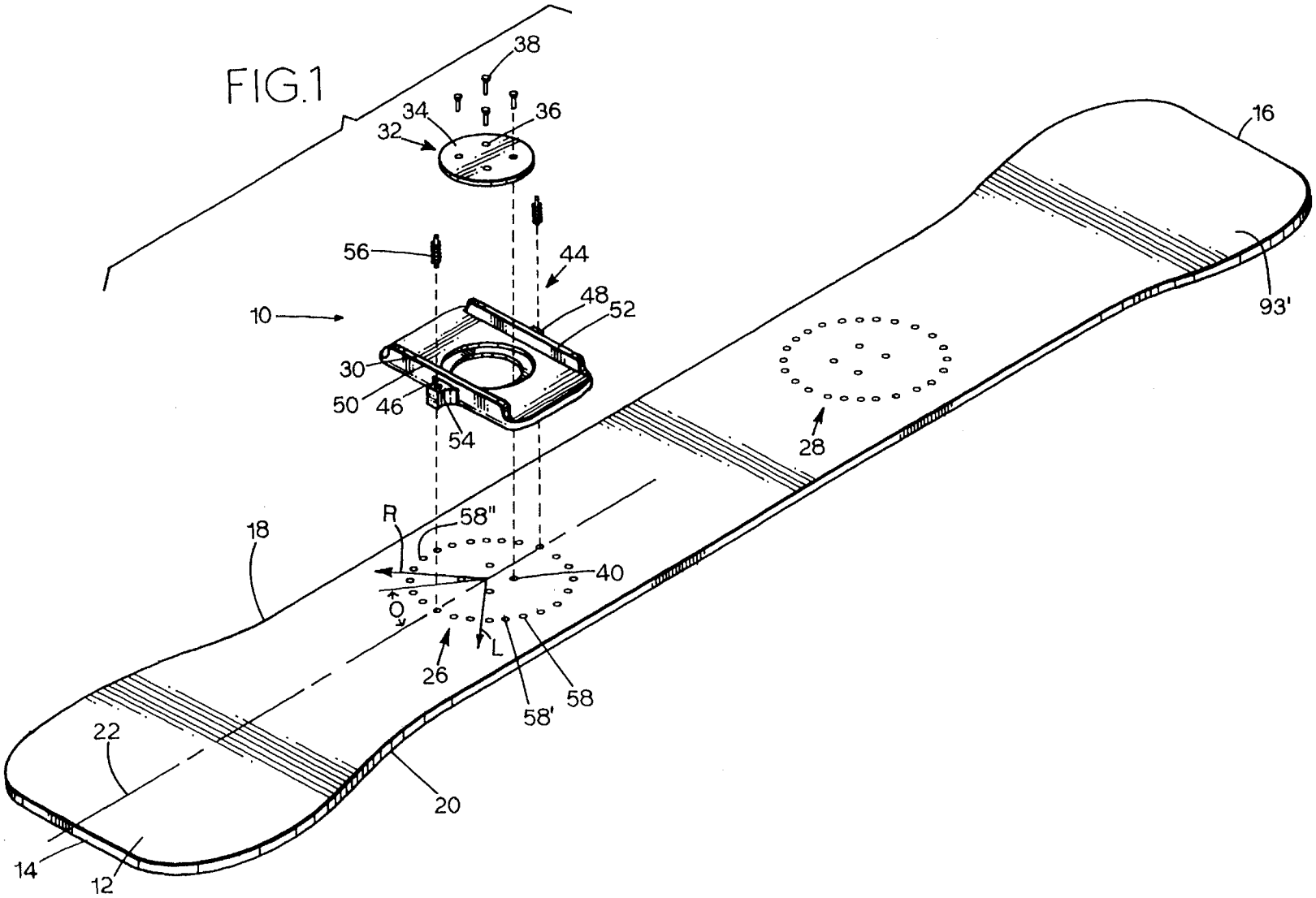
FIG. 1 is a top partially perspective view of a binding for rotatably and continuously attaching a snowboarder's foot to a snowboard embodying the present invention, with the straps and rear foot support being deleted from this view for clarity of description.

Shown in FIG. 1 is a binding footplate 10 for attaching a snowboarder's foot to a snowboard 12 having a front end 14 and an aft end 16 with sides 18 and 20 and a longitudinal centerline 22, with said footplate shown without all necessary top boot straps and rear foot support for clarity of description. Snowboard 12 has places for both feet, including a forward foot receiving means 26 and a rear foot receiving means 28. The bindings associated with each of the foot receiving means are identical; therefore, only one binding will be described. The rear foot support is also rivet held to the footplate and acts to allow the rider to generate pressure against it, from his calf, in leaning backward to a finite degree, but has the ability to move or pivot very far forward to allow the rider to lean forward without restriction (although this is limited to a finite degree as well).

Figure 5:
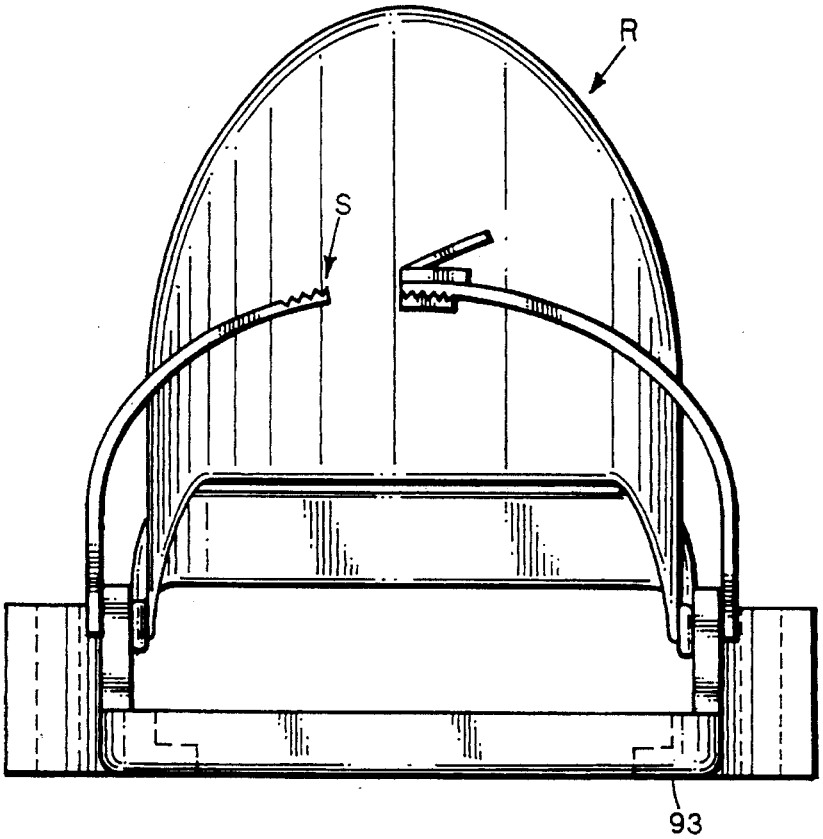
FIG. 5 is a front end elevational view of the footplate, the opposite end being a mirror image of the front end shown in FIG. 5 with the straps and rear foot support being indicated.
Figure 7:
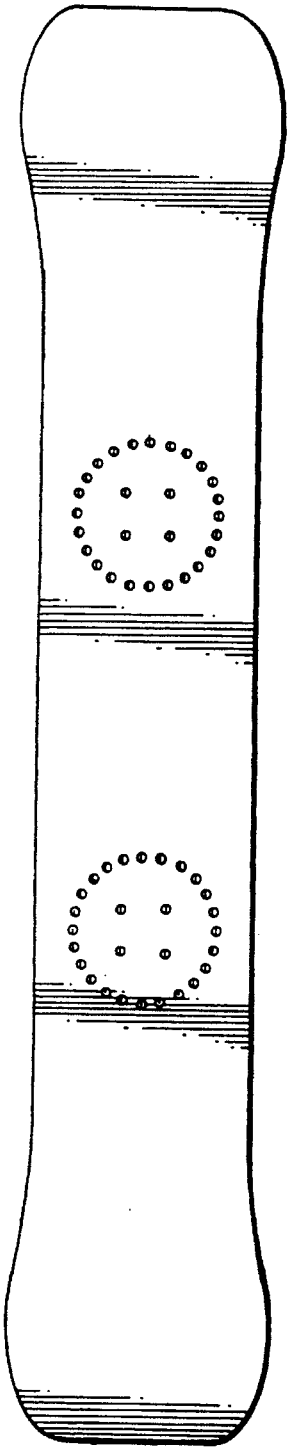
FIG. 7 is a top plan view of a snowboard having securing means receiving holes defined therein at locations for the front and rear feet of the snowboarder.

Binding 10 includes a footplate 30 which is fixed to the user's foot via the boot. As shown in FIG. 5, footplate 30 has means for attaching the snowboarder's foot directly to the footplate via the boot. This means includes straps S and rear foot supports R which secure the snowboarder's foot/boot to footplate 30. These straps are highly movable and are attached to the sidewalls of the footplate by rivets that allow them to rotate or spin to accommodate larger or smaller boot heights. Each strap is comprised of two parts, one male part M and one female part F which once engaged together act to hold the boot in place. Footplate 30 remains fixed to the user's foot during orientation and reorientation of the foot with respect to the board as will be described below. An anchor means 32 rotatably and continuously attaches footplate 30 to the snowboard with the bottom of the footplate in contact with the top surface of the snowboard and includes first fastener means, such as a circular plate 34 having a plurality of fastener receiving holes, such as hole 36, defined therethrough for receiving fasteners, such as bolt 38, which fixedly and continuously attach plate 34 to snowboard 12 via securing means which includes fastener receiving holes, such as hole 40. As will be discussed below, anchor means 32 includes a second fastener means for rotatably attaching the footplate to the snowboard. The plate 34 slidably contacts footplate 30 and anchors that footplate to the snowboard while the footplate is rotated through an angle Θ with respect to centerline 22. Angle Θ can be as much as three hundred sixty degrees. Angle Θ is sufficient to permit a user to reorient his foot from an orientation with his toes pointing to the left of centerline 22 as indicated by arrow L to an orientation with his toes pointing to the right of centerline 22 as indicated by arrow R. In one form of the binding, angle Θ can be ninety degrees. It is significant that the user's foot will remain attached to the snowboard during this reorientation through angle Θ, and has the bottom thereof as close to the plane of the snow as possible whereby the snowboarder can maintain the same amount of control over the snowboard as a skier maintains over his skis.

Binding footplate 10 further includes securing means 44 for securing footplate 30 in a selected angular orientation on the snowboard. Securing means 44 includes two wings 46 and 48 on footplate sides 50 and 52 respectively through which fastener receiving holes, such as hole 54, are defined. Fasteners, such as anti-spring pin 56, are accommodated through holes 54 and are received in pin receiving means, such as fastener receiving holes, such as hole 58, defined in the snowboard to secure the footplate in a selected orientation on the snowboard.

The footplate, with the user's boot attached thereto, is moved by withdrawing using a single Y-leash attached to the anti-pivot spring pins 56 to pull them out of their respective left and right side holes 58, rotating the footplate through angle Θ, and then replacing pins 56 in new holes. The movement is indicated in FIG. 1 by holes 58' and 58" which are spaced apart by angle of greater than ninety degrees, with pin 56 being first received in hole 58' and then in hole 58" after the angular reorientation of the footplate.

Figure 6:
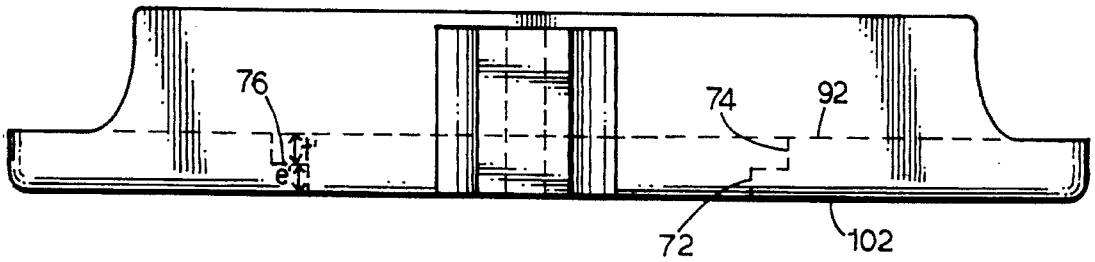
FIG. 6 is a side elevational view of the footplate, the side opposite being a mirror image of the side shown in FIG. 6, with the straps and rear foot support being deleted from this view for clarity of description.

Footplate 30 is shown in FIGS. 2, 5 and 6 to include a planar base 60 having a forward end 62 and a rear end 64 as well as sides 50 and 52 which extend along the length of the snowboarder's foot, with ends 62 and 64 extending transverse to the user's foot. Elements 66 attach the base to the snowboot. The second fastener means includes a circular hole 68 is defined through the base 60 and includes a flange 70 circumnavigating that hole. As seen in FIG. 6 the second fastener means further includes, flange 70 which has an inner surface 72 which is radially inwardly offset from inner surface 74 of planar base 60 adjacent to hole 68. An annular shoulder 76 is defined by flange 72. Shoulder 76 has a smooth surface for a purpose that will be understood from the ensuing disclosure.

As can be understood from the Figures, especially FIG. 2, wings 46 and 48 are located outside the outer perimeter of a snowboarder's boot when that boot is attached to the footplate. This places holes 54 outside the outer perimeter of the boot as well whereby the securing means, including the pins 56, can be manipulated while the snowboarder's foot remains attached to the footplate, and via the footplate to the snowboard.

The second fastener means further includes elements on the circular plate that co-operate with the above-discussed elements on the footplate. Referring to FIGS. 1, 3 and 4, it is seen that circular plate 34 of anchor means 32 includes an outer perimeter 80 having an outer diameter that is just slightly smaller than the inner diameter of inner surface 74 so the plate outer perimeter fits into hole 68 with outer perimeter surface 80 being slidably engaged with inner surface 74. Plate 34 also includes a central section 82 having an outer surface 84. Outer surface 84 has an outer diameter that is just slightly smaller than the inner diameter of flange 72 whereby section 82 is in sliding contact with flange 72 when the plate is in place in hole 68. As can be seen in FIG. 4, central section 82 is offset from surface 80 radially inwardly of the plate whereby a flange 86 is defined. The thickness t of flange 86 as defined between top surface 88 of plate 34 and bottom surface 90 of flange 86 is essentially equal to the thickness t' of surface 74 as measured between top surface 92 of base 50 and shoulder 76 whereby top surface 88 of plate 34 is essentially coplanar with top surface 92 of footplate base 60. This may contribute to the overall comfort of the binding. However, more importantly, the coplanar orientation of the top surface 88 and the top surface of footplate base 60 positions the bottom of the snowboarder's foot as close to the plane of the snow as possible. The hole 68 permits the bottom surface 93 (see FIG. 5) of the footplate to contact top surface 93' of the snowboard when snowboarding and even when reorienting the snowboarder's foot. This permits the snowboarder to keep his foot as close to the plane of the snow as possible and to keep his foot in that position during a reorientation so he can know what the board will feel like in each orientation. Knowing what the board will feel like will help the snowboarder know which orientation he wants for a particular condition; while keeping the bottom of the footplate in contact with the top of the snowboard will permit the snowboarder to know what the snowboarding conditions are during the reorientation as well. Holes 36 can be countersunk whereby bolts 38 do not extend above the plane of surface 88, with the bolts 38 having straight slots for receiving a blade screwdriver.

Plate 34 has a bottom surface 100 which abuts the top surface of the snowboard, and which is spaced from lower surface 90 of flange 86 a distance 1 that is slightly larger than spacing 1' between bottom surface 102 of footplate 30 and shoulder 76, and the radial distance between surface 80 and surface 84 is slightly larger than the radial distance between shoulders 72 and 74 so surface 90 can slide on top of shoulder 76 when plate 34 is in place in hole 68 of the footplate. The materials used to form plate 34 and footplate 30 are selected so this sliding contact is easy and does not unduly wear either element. An annular graphite ring washer, indicated by a small portion thereof at RW, can be interposed between the two sliding surfaces to promote ease of rotation while inhibiting wear. The washer will cover both sliding surfaces and will be a complete circle, but is only partially shown for ease of illustration.

As can be understood from the foregoing, when plate 34 is received in hole 68, flange surface 90 is in sliding contact with shoulder 76 and a connection means is formed by the slidingly contacting surfaces of the flange 90 and the shoulder 76. When plate 34 is fixed to the snowboard by bolts 38 being attached to the snowboard adjacent to holes 40, the sliding contact between shoulder 76 and flange 86 maintains footplate 30 rotatably and continuously fixed to the snowboard. As discussed above, after pins 56 have been removed from holes 58, the footplate can be rotated on the snowboard with that footplate remaining fixed to the snowboard. Once the footplate has been rotated relative to the snowboard and relative to plate 34 fixed to the snowboard, pins 56 are replaced through holes 54 and 58 to secure the footplate in the selected orientation on the snowboard. The use of pins 56 and holes 58 permit exact and repeatable orientation of the footplate with respect to the snowboard. That is, a particular hole 58 can be selected, and each time that particular hole is used, the orientation of the foot with respect to the snowboard will be identical to all other times that hole is used. This is an important consideration in view of the fact that snowboarding conditions can be exactly predicted due to the above-discussed features of the present binding. The positioning of the foot with respect to the snowboard can be effected as accurately as the predicted feel and action of the snowboard. It is also noted that all of the anti-pivot spring pin receptacle holes are covered by the footplate itself when not in use receiving a spring pin. This keeps them free of snow, ice or other debris.

Figure 8:
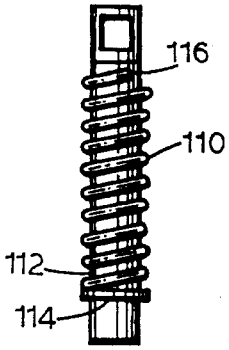
FIG. 8 is a side elevational view of an anti-pivot spring pin used to secure the footplate to the snowboard.
Figure 9:
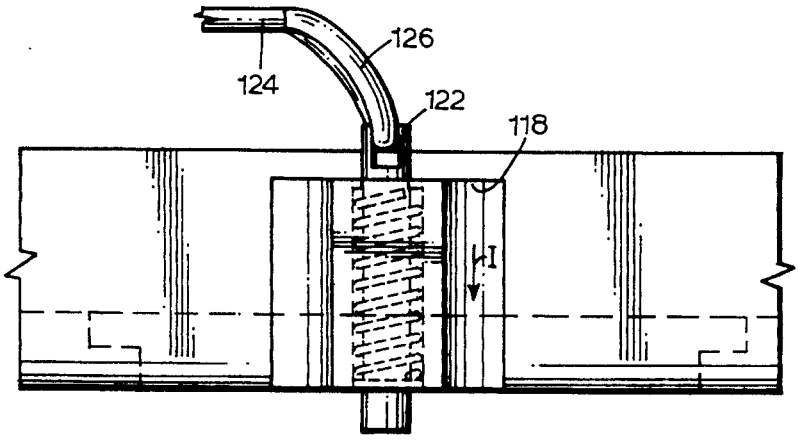
FIG. 9 is a partially cutaway view showing the anti-pivot spring pin within the binding sidewall wing and protruding into the snowboard and securing the footplate thereto.

Pins 56 are best shown in FIGS. 1, 8 and 9 and include springs 110 which bias them toward the snowboard so they must be forcefully pulled away from the snowboard to remove them from holes 58. A spring 110 surrounds each bolt and has one end 112 abutting a metal washer 114 on the bolt and another end 116 abutting an inner surface 118 of the footplate wing located adjacent to hole 54 whereby the bolt is biased in direction I shown in FIG. 9. Each bolt includes an eye 122 to which is attached a common "Y" leash 124. The "Y" leash has two loops, such as loop 126, on the pin-attaching ends and a handle (not shown) on the other end. Pulling the handle overcomes the bias of spring 110 and pulls each pin out of its respective hole 58. Once the footplate is in the desired orientation on the snowboard, the leash is released and the spring moves the pin into the newly selected hole. Spring 110 can be a coil spring or some other form of biasing means.

Figure 10:
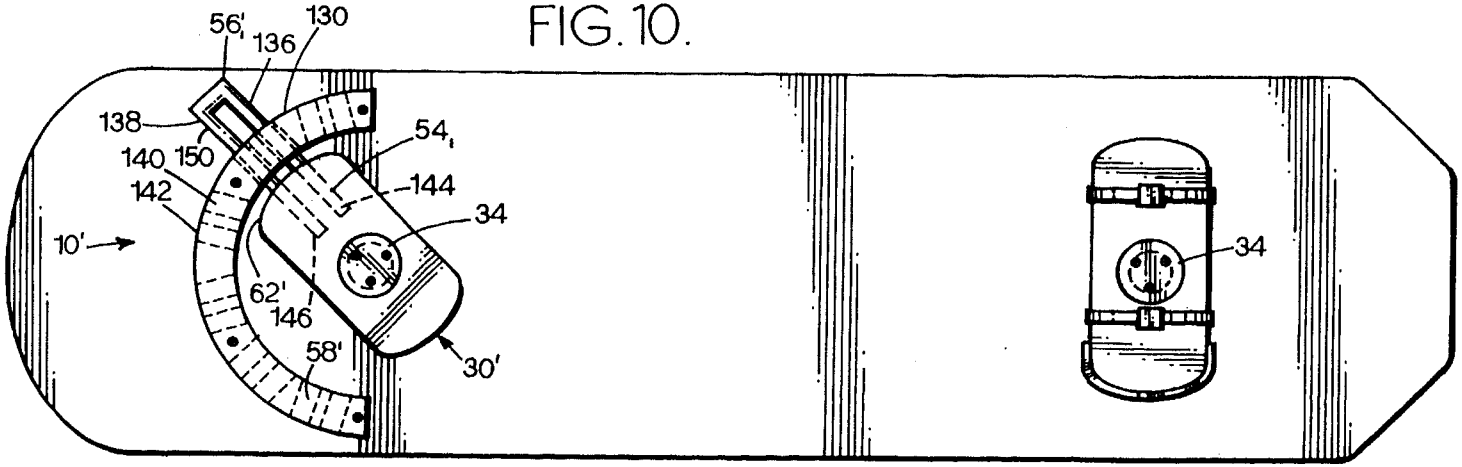
FIG. 10 is a top plan view of a second form of the binding shown without the top boot straps and rear foot support for clarity of description.
Figure 13:
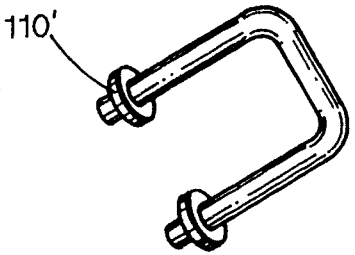
FIG. 13 is a front elevational view of a pin used to secure the second or third form of the binding in a selected orientation on the snowboard.

A second form of the invention is shown in FIG. 10 is denoted by reference indicator 10' and has an arcuate plate 130 secured to the snowboard. Arcuate plate 130 has a plurality of holes $58_1$ which correspond in function to holes 58 discussed above but which extend from the forward end of the arcuate plate to the rear end thereof and which extend parallel to the top surface of the snowboard. Binding 10' includes a footplate 30' that is similar to footplate 30 and is continuously and rotatably fixed to the snowboard by a plate 34 and has bolt receiving holes $\mathbf{54_1}$ defined in forward edge 62' thereof. A bolt $\mathbf{56_1}$ fits through holes $\mathbf{58_1}$ and is received in holes $\mathbf{54_1}$ to attach footplate 30' to arcuate plate 130 to secure the footplate to the snowboard after the footplate has been rotated as discussed above in connection with the discussion of binding 10. The preferred form of binding 10' includes a U-shaped bolt $\mathbf{56_1}$, with legs 136 and 138 extending through holes 140 and 142 in arcuate plate 130 into corresponding holes 144 and 146 in footplate 30'. A biasing means 150 surrounds the legs of the bolt to hold the bolt in the selected holes. The biasing means can include springs 110', such as shown in FIG. 13 surrounding each leg and connected thereto by washers, such as washer 112' and which abut corresponding surfaces on the arcuate plate when the bolt is in place, or an elastomeric material that frictionally engages the arcuate plate adjacent to the hole to hold the bolt in place. A leash such as discussed above can be attached to the bolts of binding 10' to remove them from the holes in the arcuate plate to move the footplate with respect to the snowboard. As discussed above, a single snowboard can include a binding in the front end and in the rear end so the position of either or both feet can be oriented as desired without removing the foot from the snowboard.

Figure 11:
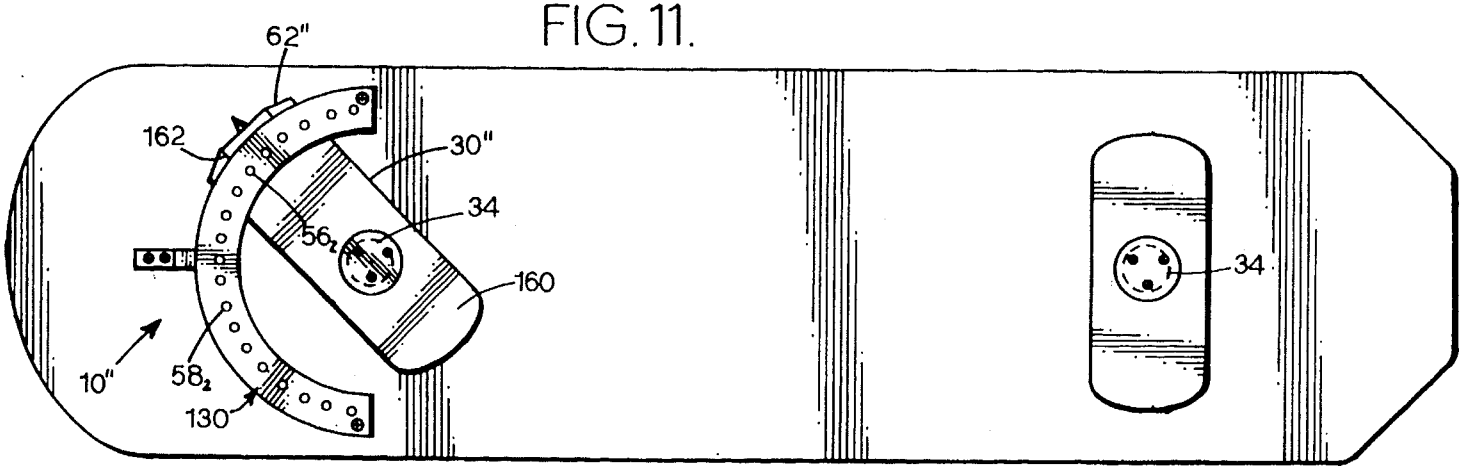
FIG. 11 is a top plan view of a third form of the binding shown without the top boot straps and rear foot support for clarity of description.
Figure 12:
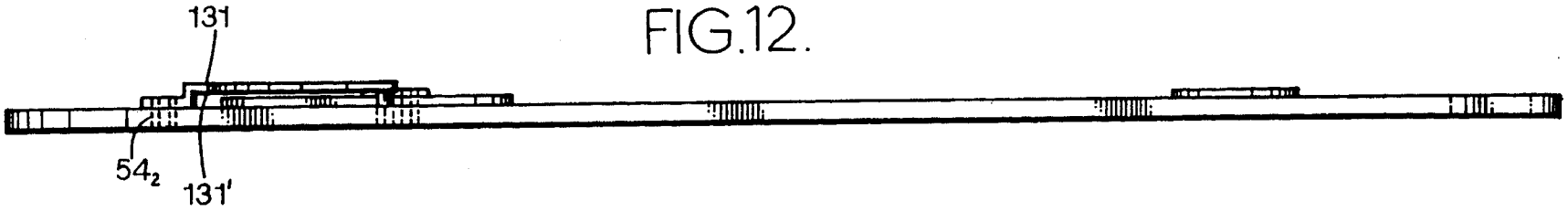
FIG. 12 is a side elevational view of the third form of the binding, shown without the top boot straps and rear foot support for clarity of description.

Yet a third form of the binding is shown in FIGS. 11 and 12 as binding 10". Binding 10" includes an arcuate plate 130' which has a plurality of holes $\mathbf{58_2}$ which are directed toward the top surface of the snowboard and extend from top surface 131 of the arcuate plate to bottom surface 131' of the arcuate plate. Plate 130' is attached to the snowboard to have bottom surface 131' spaced from the top surface of the snowboard, and footplate 30" has a front end 62" that extends beneath this bottom surface 131'. Top surface 160 of footplate 30" is in sliding contact with bottom surface 131', and two holes $\mathbf{54_2}$ are defined through the footplate to be aligned with the holes $\mathbf{58_2}$ in the arcuate plate so a bolt $\mathbf{56_2}$ can extend through aligned holes $\mathbf{54_2}$ and $\mathbf{58_2}$ to secure the footplate to the snowboard. Bolt $\mathbf{56_2}$ is similar to the above discussed bolts and is biased into a hole engaging position as discussed above. Alignment marks 162 are defined on the footplate to help a user align holes $\mathbf{54_2}$ and $\mathbf{58_2}$. As discussed above, a single snowboard can include a binding located near the front end thereof and a second binding located near the rear end thereof. A flange 170 attaches arcuate plate 130' to the snowboard with fasteners 172 fixing the arcuate plate to the snowboard via fastener-receiving holes, such as hole $\mathbf{54_3}$ defined in the snowboard.

It is understood that while certain forms of the present invention have been illustrated and described herein, it is not to be limited to the specific forms or arrangements of parts described and shown.

I claim:

1. A binding for attaching a snowboarder's foot to a snowboard comprising:

A) a footplate having an outer perimeter and means for attaching said footplate directly to a snowboarder's boot when the snowboarder's foot is in the boot, said footplate having a bottom surface and said means positioning said bottom surface in direct contact with a top surface of the snowboard thereby placing a wearer's foot immediately adjacent to the top surface of the snowboard;

B) anchor means for rotatably attaching said footplate with the foot-containing boot attached thereto to a snowboard and maintaining said footplate and foot-containing boot continuously attached to said snowboard even when said footplate is rotated through an angle of ninety degrees or more with respect to a longitudinal centerline of the snowboard; and C) securing means for accurately and repeatably securing said footplate in a selected angular orientation, said securing means including a plurality of holes defined in the snowboard, said holes being arcuately arranged on the snowboard to be located outside of the outer perimeter of a user's foot on said footplate.

2. The binding defined in claim 1 wherein the boot has an outer perimeter and said securing means is located outside of said outer perimeter.

3. A binding for attaching a snowboarder's foot to a snowboard comprising:

A) a footplate having an outer perimeter, a bottom surface and means for attaching said footplate to a snowboarder's boot when a snowboarder's foot is in the boot;

B) anchor means for rotatably attaching said footplate with the snowboarder's boot attached thereto to a snowboard having a top surface and a longitudinal centerline, said anchor means positioning said bottom surface in direct contact with the top surface of the snowboard and maintaining said footplate and snowboarder's boot continuously attached to the snowboard even when said footplate is rotated through an angle of ninety degrees or more with respect to the longitudinal centerline of the snowboard, said anchor means including (1) first fastening means fixed to the snowboard for attaching said anchor means to the snowboard, (2) second fastening means for rotatably attaching said footplate to said first fastening means, said second fastening means being in sliding contact with said first fastening means and remaining in continuous sliding contact with said first fastening means when said footplate is rotated through said angle, and (3) securing means for accurately and repeatably securing said footplate in a selected angular orientation, said securing means including a plurality of holes defined in the snowboard and extending for at least a ninety degree arc which extends across the longitudinal centerline of the snowboard and which are located outside the outer perimeter of a user's foot on said footplate.

4. A binding for attaching a snowboarder to a snowboard comprising:

A) a footplate secured to a snowboarder's boot, said footplate having an outer perimeter, a bottom surface and a base, and including (1) means on said base for mounting pin means on said base, and (2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined in the snowboard and located outside the outer perimeter of a user's foot on said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in contact with the top surface of the snowboard when said footplate is rotated with the snowboarder's foot in the boot and attached to said footplate;

E) anchor means for fixing said fastening means to the snowboard; and

F) connection means for movably connecting said fastening means to said footplate and for permitting said footplate to rotate with respect to said fastening means with said fastening means fixed to the snowboard.

5. The binding defined in claim 4 wherein said base has an opening defined therethrough and a base flange located adjacent to said opening, said fastening means including a circular plate having a flange on the outer perimeter thereof which slidably engages said base flange to secure said base to the snowboard via said fastening means.

6. The binding defined in claim 5 wherein the snowboard includes a front end and an aft end and said arcuate pin receiving means is located adjacent to said front end.

7. The binding defined in claim 5 wherein the snowboard includes a front end and an aft end and said arcuate pin receiving means is located adjacent to said aft end.

8. The binding defined in claim 5 wherein said pin receiving means extends for three hundred sixty degrees.

9. The binding defined in claim 8 wherein said footplate includes two side edges and said receptacle means includes a wing on each of said side edges.

10. The binding defined in claim 9 wherein said pin means includes a spring means for biasing said pin means toward said pin receiving means and release means on said pin means for removing said pin means from said pin receiving means to permit said footplate to rotate with respect to the snowboard while said fastening means maintains said footplate secured to the snowboard.

11. A binding for attaching a waterboarder's foot to a waterboard comprising:

A) a footplate having an outer perimeter and means for attaching said footplate to a waterboarder's footbinding when a waterboarder's foot is in the footbinding, said footplate having a bottom surface, said means for attaching said footplate to the waterboarder's footbinding positioning said bottom surface in direct contact with a top surface of a waterboard thereby placing a wearer's foot immediately adjacent to the top surface of the waterboard;

B) anchor means for rotatably attaching said footplate with the foot-containing footbinding attached thereto to the waterboard and maintaining said footplate and foot-containing footbinding continuously attached to the waterboard even when said footplate is rotated through an angle of ninety degrees or more with respect to a longitudinal centerline of the waterboard; and C) securing means for accurately and repeatably securing said footplate in a selected angular orientation, said securing means including a plurality of holes defined in the waterboard, said holes being arcuately arranged on the waterboard to be located outside of the outer perimeter of a user's foot on said footplate.

12. A binding for attaching a snowboarder to a snowboard comprising:

A) a footplate fixedly secured to a snowboarder's boot, said footplate having a bottom surface, and including
(1) a base having an opening defined therethrough and a base flange located adjacent to said opening,
(2) receptacle means on said base for mounting pin means on said base, and
(3) mounting means on said base for fixing said footplate to the snowboarder's foot;

B) an arcuate pin receiving means on a snowboard for releasably receiving said pin means and maintaining said footplate in a selected orientation on the snowboard with respect to a longitudinal centerline of the snowboard, said pin receiving means including a plurality of holes defined in the snowboard and extending for three hundred sixty degrees;

C) fastening means for fixedly securing said footplate to the snowboard and maintaining said footplate continuously secured to the snowboard with said footplate bottom surface in contact with the top surface of the snowboard when said footplate is rotated with the snowboarder's foot in the boot and attached to said footplate, said fastening means including a circular plate having a flange on the outer perimeter thereof which slidably engages said base flange to secure said base to the snowboard via said fastening means;

D) anchor means for fixing said fastening means to the snowboard; and

E) connection means for movably connecting said fastening means to said footplate and for permitting said footplate to rotate with respect to said fastening means with said fastening means fixed to the snowboard.

13. A binding for attaching a snowboarder to a snowboard comprising:

A) a footplate secured to a snowboarder's boot, said footplate having an outer perimeter, a bottom surface and a base, and including
(1) means on said base for mounting pin means on said base, and
(2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined in the snowboard to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in contact with the top surface of the snowboard when said footplate is rotated with the snowboarder's foot in the boot and attached to said footplate, said fastening means including a flange;

E) anchor means for fixing said fastening means to the snowboard; and

F) connection means for movably connecting said fastening means to said footplate and for permitting said footplate to rotate with respect to said fastening means with said fastening means fixed to the snowboard, said securing means including a flange which slidably contacts the flange of said fastening means.

14. A binding for attaching a snowboarder to a snowboard comprising:

A) a footplate having means for securing said footplate to a snowboarder's boot, said footplate having an outer perimeter, a bottom surface and a base, and including (1) means on said base for mounting pin means on said base, and (2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined in the snowboard to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in contact with the top surface of the snowboard when said footplate is rotated with the snowboarder's foot in the boot and attached to said footplate;

E) anchor means for fixing said fastening means to the snowboard; and

F) connection means for movably connecting said fastening means to said footplate and for permitting said footplate to rotate with respect to said fastening means with said fastening means fixed to the snowboard.

15. A binding for attaching a snowboarder to a snowboard comprising:

A) a footplate having means for securing said footplate to a snowboarder's boot, said footplate having an outer perimeter, a bottom surface and a base, and including (1) means on said base for mounting pin means on said base, and (2) mounting means on said base for fixing said footplate to the snowboarder's boot;

B) pin means for releasably fixing said footplate in a selected orientation on the snowboard;

C) a pin receiving means on a snowboard for releasably receiving said pin means and maintaining said footplate in a selected orientation on the snowboard with respect to a longitudinal centerline of the snowboard, said pin receiving means including a plurality of holes defined in the snowboard to be located outside a perimeter of a user's foot when that user's foot is attached to the snowboard by said footplate and extending for at least a ninety degree arc which extends across the longitudinal centerline whereby said footplate can be rotated at least ninety degrees on the snowboard;

D) fastening means for securing said footplate to the snowboard and maintaining said footplate continuously secured to the snowboard with said footplate bottom surface in contact with the top surface of the snowboard when said footplate is rotated with the snowboarder's foot in the boot and attached to said footplate, said fastening means including a flange;

E) anchor means for fixing said fastening means to the snowboard; and

F) connection means for movably connecting said fastening means to said footplate and for permitting said footplate to rotate with respect to said fastening means with said fastening means fixed to the snowboard, said securing means including a flange which slidably contacts the flange of said fastening means.

* * * * *